US007954740B2

(12) United States Patent
Chen

(10) Patent No.: US 7,954,740 B2
(45) Date of Patent: Jun. 7, 2011

(54) PRESSURE DIFFERENTIAL NANO GRINDING AND DISPERSING ASSEMBLY

(75) Inventor: Kuo Kang Chen, Taipei (TW)

(73) Assignee: Rosace International Co., Ltd., Taipei (TW)

( * ) Notice: Subject to any disclaimer, the term of this patent is extended or adjusted under 35 U.S.C. 154(b) by 313 days.

(21) Appl. No.: 12/403,019

(22) Filed: Mar. 12, 2009

(65) Prior Publication Data

US 2010/0233941 A1 Sep. 16, 2010

(51) Int. Cl.
*B02B 1/00* (2006.01)
*B02B 5/02* (2006.01)
*B02C 21/00* (2006.01)

(52) U.S. Cl. ..... 241/62; 241/162; 241/163

(58) Field of Classification Search ..... 241/46.06, 241/62, 161–163
See application file for complete search history.

(56) References Cited

U.S. PATENT DOCUMENTS 4,747,550 A * 5/1988 Jackering ..... 241/55
5,337,966 A * 8/1994 Francis et al. ..... 241/46.06
5,695,130 A * 12/1997 Csendes ..... 241/19
5,826,807 A * 10/1998 Csendes ..... 241/19
5,850,977 A * 12/1998 Csendes ..... 241/17
5,865,381 A * 2/1999 Mitsumura et al. ..... 241/18
6,135,371 A * 10/2000 Csendes ..... 241/15

* cited by examiner

*Primary Examiner* — Bena Miller
(74) *Attorney, Agent, or Firm* — Frenkel & Associates, P.C.

(57) ABSTRACT

A nano grinding and dispersing assembly has a raw material feeder, a liquid supply unit connecting to the delivering pipe of the raw material feeder, a gas supply unit connecting to the delivering pipe of the raw material feeder, a pressure equalized assembly and a subsequent treatment plant. The raw material feeder has a feeding pipe connecting to the raw material feeder and a delivering pipe connecting to the raw material feeder. The pressure equalized assembly has a pressure equalizer, a pressurized feeding pipe, a gas-liquid separator, a pressure gage and a first grinding device. The first grinding device connects and communicates with the pressure equalizer and has at least one ground fluid outlet. The subsequent treatment plant connects the ground fluid outlet of the first grinding device. Therefore, the present invention completely mixes, grinds and disperses fluid to make the fluid homogeneous.

20 Claims, 7 Drawing Sheets

PRESSURE DIFFERENTIAL NANO GRINDING AND DISPERSING ASSEMBLY

BACKGROUND OF THE INVENTION

1. Field of Invention

The present invention relates to a nano grinding and dispersing assembly, and more particularly to a pressure differential nano grinding and dispersing assembly that completely mixes liquid with solid, liquid or gas using high-pressure grinding.

2. Description of the Related Art

In our environment, a substance will change into different phases (including gas, liquid and solid) according to temperature. Solubilities of two substances such as element and compound, organic matter and inorganic matter, gas and liquid, liquid and solid or the like are all different because they have different phases or different physical properties. Therefore, external force should be applied or a specific device should be used to improve mutual solubility of two substances.

For example, when solid powder dissolves in liquid or gas dissolves in liquid, a conventional method to improve mutual solubility of two substances comprises using pressurizing the substances. However, when solid powder dissolves in liquid or gas dissolves in liquid, the solid powder/gas cannot be in nano-scale and cannot disperse evenly in the liquid during dissolving in the liquid. Therefore, a grinding and dispersing device is still being sought.

To overcome the shortcomings, the present invention provides a nano grinding and dispersing assembly to mitigate or obviate the aforementioned.

SUMMARY OF THE INVENTION

The primary objective of the present invention is to provide a nano grinding and dispersing assembly that completely mixes fluid with solid, fluid or gas using high-pressure grinding.

To achieve the objective, the nano grinding and dispersing assembly in accordance with the present invention comprises a raw material feeder, a liquid supply unit connecting to the delivering pipe of the raw material feeder, a gas supply unit connecting to the delivering pipe of the raw material feeder, a pressure equalized assembly and a subsequent treatment plant. The raw material feeder has a feeding pipe and a delivering pipe. The feeding pipe connects the raw material feeder. The delivering pipe connects the raw material feeder. The pressure equalized assembly has a pressure equalizer, a pressurized feeding pipe, a gas-liquid separator, a pressure gage and a first grinding device. The pressurized feeding pipe connects and communicates with the pressure equalizer. The gas-liquid separator connects and communicates with the pressure equalizer. The pressure gage connects the pressure equalizer. The first grinding device connects and communicates with the pressure equalizer and has at least one ground fluid outlet. The subsequent treatment plant connects the ground fluid outlet of the first grinding device.

Therefore, the present invention completely mixes, grinds and disperses fluid to make the fluid homogeneous.

Other objectives, advantages and novel features of the invention will become more apparent from the following detailed description when taken in conjunction with the accompanying drawings.

DETAILED DESCRIPTION OF THE INVENTION

Figure 1:
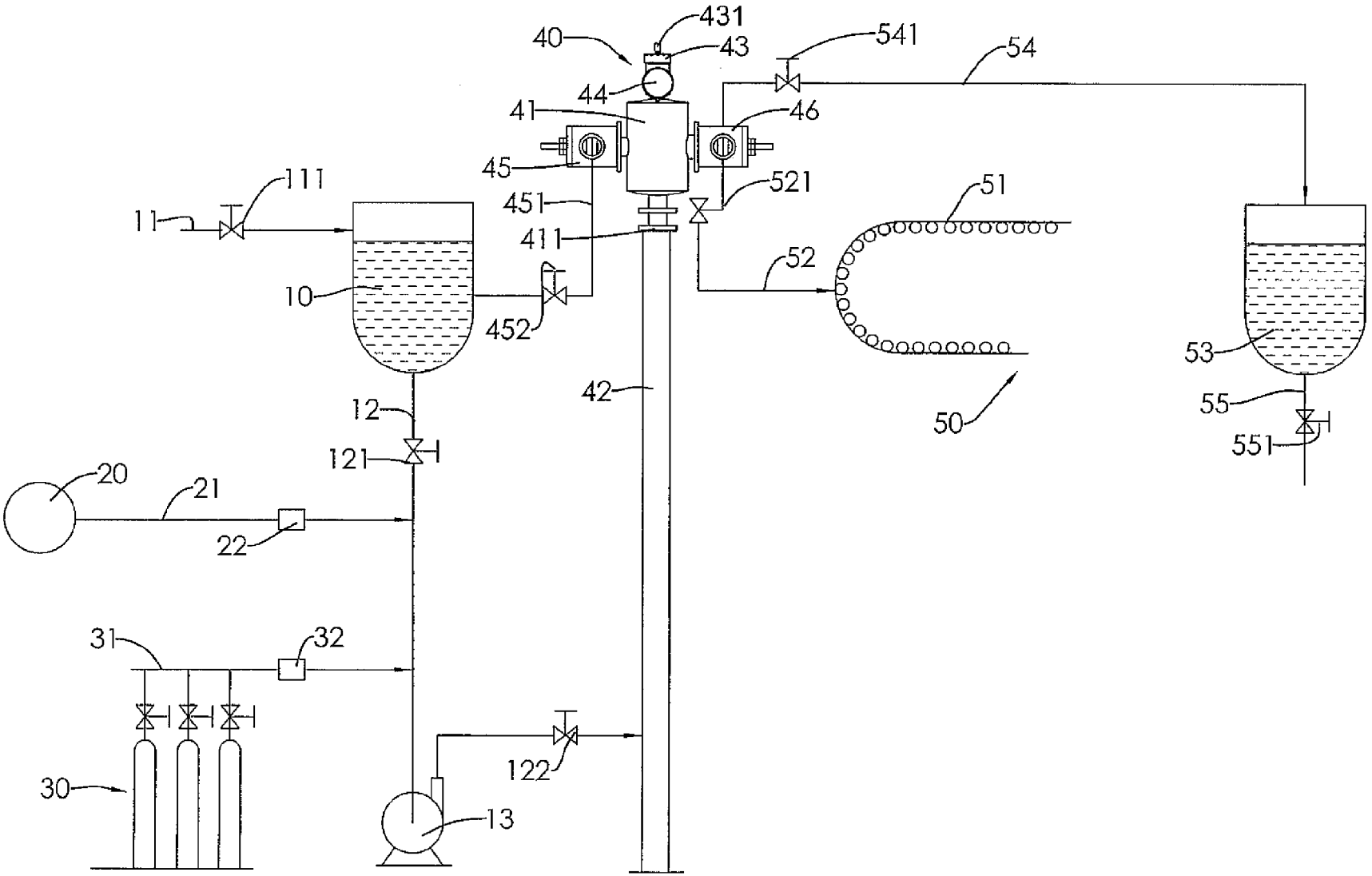
FIG. 1 is a schematic diagram of a nano grinding and dispersing assembly in accordance with the present invention.

With reference to FIG. 1, a pressure differential nano grinding and dispersing assembly in accordance with the present invention comprises a raw material feeder (10), a liquid supply unit (20), a gas supply unit (30), a pressure equalized assembly (40) and a subsequent treatment plant (50).

The raw material feeder (10) has an inner chamber, a top, a bottom, a sidewall, a feeding pipe (11) and a delivering pipe (12). The inner chamber has liquid raw material. The feeding pipe (11) connects to the sidewall near the top of the raw material feeder (10), communicates with the inner chamber of the raw material feeder (10) and has a valve (111). The delivering pipe (12) connects to the bottom of the raw material feeder (10), communicates with the inner chamber of the raw material feeder (10) and has a pump (13) and multiple valves (121, 122). The valves (121, 122) are mounted at interval on the delivering pipe (12).

The liquid supply unit (20) supplies liquid or liquid containing solid powder and has a liquid feeding pipe (21) and a flow meter (22). The liquid feeding pipe (21) connects to the delivering pipe (12) between the raw material feeder (10) and the pump (13). The flow meter (22) is mounted on the liquid feeding pipe (21) to detect flow rate of the liquid in the liquid feeding pipe (21).

The gas supply unit (30) supplies gas, has a gas feeding pipe (31) and a flow meter (32) and may have at least one gas cylinder. Numbers of the gas cylinder depend on a desired amount of gas and gas type depends on desired mixed fluid including gas and the liquid raw material. The gas feeding pipe (31) connects to the delivering pipe (12) between the raw material feeder (10) and the pump (13). The flow meter (32) is mounted on the gas feeding pipe (31) to detect flow rate of the gas in the gas feeding pipe (31).

Figure 2:
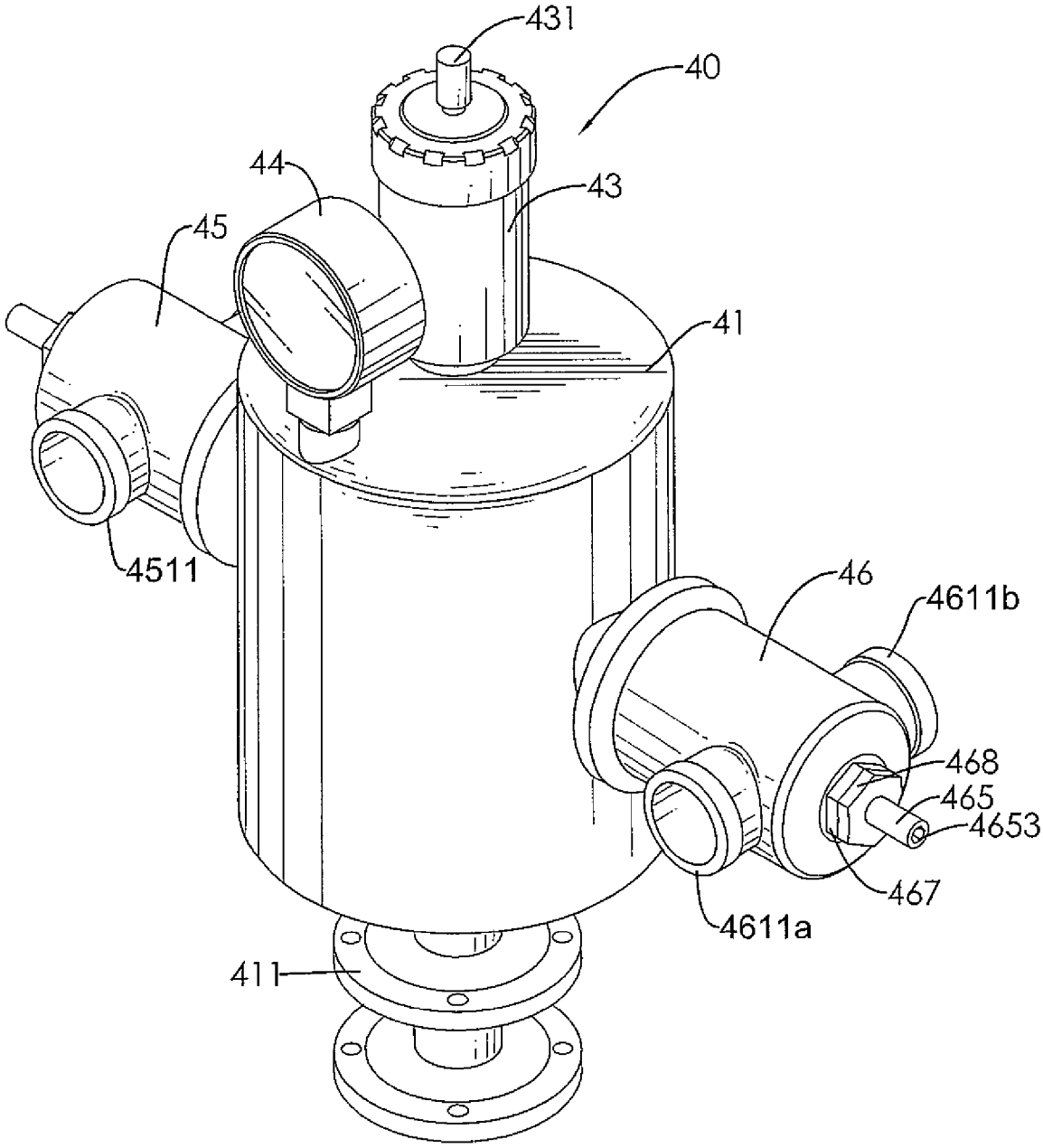
FIG. 2 is a perspective view of a pressure equalized assembly of the nano grinding and dispersing assembly in FIG. 1.
Figure 3:
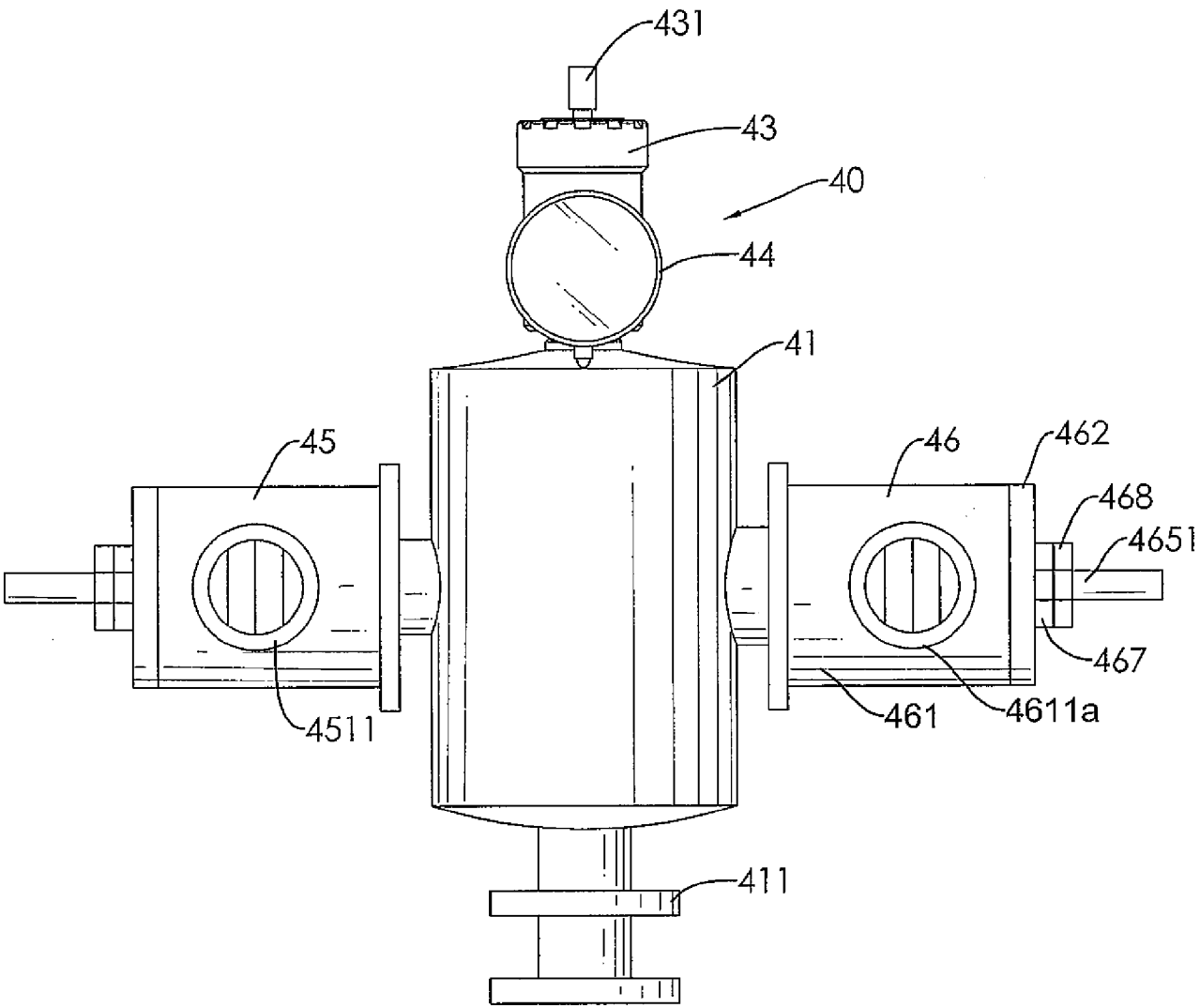
FIG. 3 is a front view of the pressure equalized assembly in FIG. 2.

With further reference to FIGS. 2 and 3, the pressure equalized assembly (40) has a pressure equalizer (41), a pressurized feeding pipe (42), a gas-liquid separator (43), a pressure gage (44), a first grinding device (46) and a second grinding device (45).

The pressure equalizer (41) has an inner chamber, a top, a bottom, a sidewall and a joint (411). The joint (411) is mounted on the bottom of the pressure equalizer (41).

The pressurized feeding pipe (42) connects to the delivering pipe (12) and has a top end. The top end of the pressurized feeding pipe (42) connects to the joint (411), communicates with the pressure equalizer (41) and allow fluid in the delivering pipe (12) to flow into the pressure equalizer (41).

The gas-liquid separator (43) is mounted on the top of the pressure equalizer (41), communicates with the pressure equalizer (41) and has a gas outlet (431).

The pressure gage (44) is mounted on the top of the pressure equalizer (41) and communicates with the pressure equalizer (41) to detect the pressure in the pressure equalizer (41), so an operator is able to adjust the pressure of the pressure equalized assembly (40) according to the pressure gage (44).

The first grinding device (46) connects to the sidewall of the pressure equalizer (41), communicates with the inner chamber of the pressure equalizer (41) and has at least one ground fluid outlet (4611*a*, 4611*b*). The first grinding device (46) has a hollow barrel (461), a cover (462), multiple grinding sheets (463), a fastening shaft (464) and a pressure regulating shaft (465).

Figure 4:
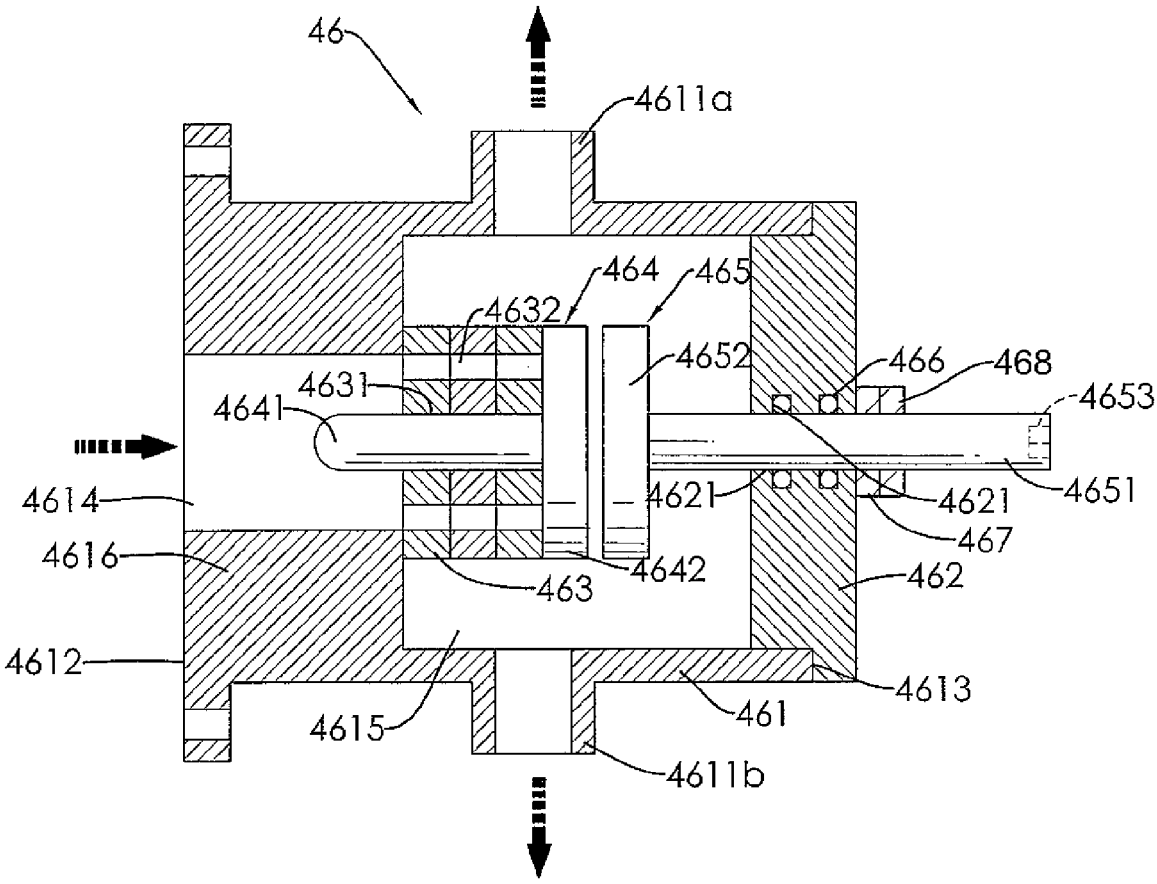
FIG. 4 is a top view in partial section of a grinding device of the pressure equalized assembly of the nano grinding and dispersing assembly in FIG. 2.
Figure 5:
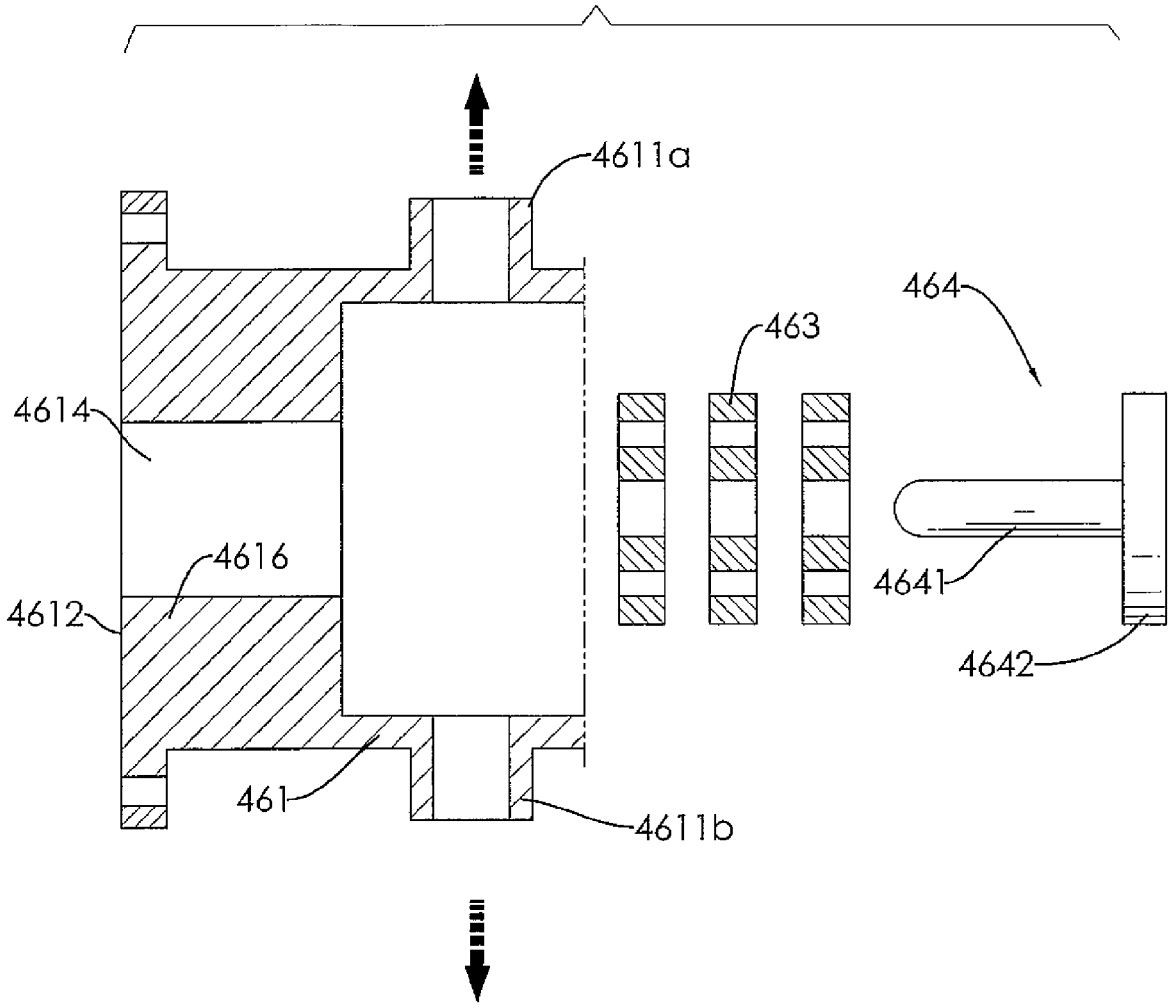
FIG. 5 is an exploded top view in partial section of a proximal part of the grinding device in FIG. 4.

With further reference to FIGS. 4 and 5, the barrel (461) has an open proximal end (4612), an open distal end (4613), a sidewall, an inner chamber (4615), two ground fluid outlets (4611*a*, 4611*b*) and an annular protrusion (4616). The proximal end (4612) connects to the pressure equalizer (41). The distal end (4613) has an outlet opening. The sidewall has an inner surface. The ground fluid outlets (4611*a*, 4611*b*) connect to the sidewall of the barrel (461) and communicate with the inner chamber (4615) of the barrel (461). The annular protrusion (4616) protrudes radially inwards from the inner surface of the sidewall and is formed in the inner chamber (4615) near the proximal end (4612) to form an inlet channel (4614). The inlet channel (4614) communicates with the pressure equalizer (41).

The cover (462) is mounted in and seals the outlet opening of the distal end (4613) of the barrel (461) and has a central hole (4621). The central hole (4621) is defined through the cover (462) and communicates with the inner chamber (4615).

Figure 6:
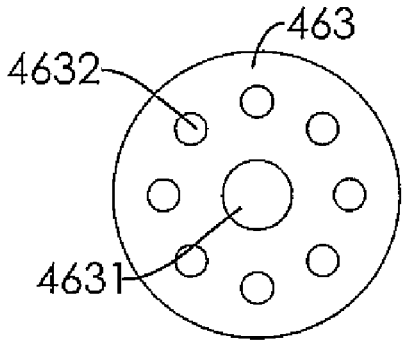
FIG. 6 is an end view of a grinding sheet of the grinding device in FIG. 4.
Figure 7:
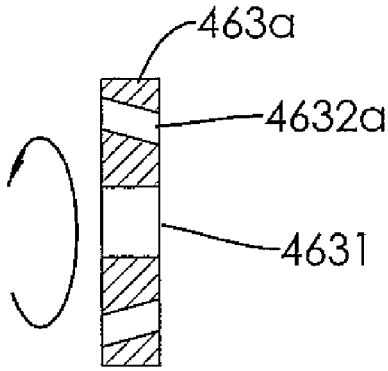
FIG. 7 is a cross sectional side view of a clockwise grinding sheet of the grinding device in FIG. 4.
Figure 8:
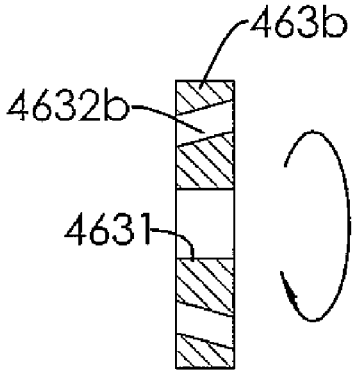
FIG. 8 is a cross sectional side view of a counter-clockwise grinding sheet of the grinding device in FIG. 4.

With further reference to FIG. 6 to FIG. 8, the grinding sheets (463) are mounted in the inner chamber (4615) and an interval is formed between the grinding sheets (463) and the inner surface of the sidewall of the barrel (461). Each grinding sheet (463) has a proximal surface, a distal surface, an axle hole (4631) and multiple diversion holes (4632, 4632*a*, 4632*b*). The axle hole (4631) is defined centrally through the grinding sheet (463) and has a first axis. The diversion holes (4632, 4632*a*, 4632*b*) are formed around the axle hole (4631) at intervals and each diversion hole (4632, 4632*a*, 4632*b*) has a second axis and a slanted degree. The slanted degree is between a the second axis of the diversion hole (4632, 4632*a*, 4632*b*) and the first axis of the axle hole (4631) and is in a range from 0° to 60°. In one aspect, the diversion hole (4632, 4632*a*, 4632*b*) may be parallel with the horizontal plane (the slanted degree is)0° as shown in FIG. 4. In another aspect, the grinding sheet (463) may be a clockwise grinding sheet (463*a*) that is slanted toward the axle hole (4631) from the proximal surface of the grinding sheet (463) to the distal surface of the grinding sheet (463) as shown in FIG. 7. In yet another aspect, the grinding sheet (4632, 4632*a*, 4632*b*) may be a counterclockwise grinding sheet (463*b*) that is slanted toward the sidewall of the barrel (461) from the proximal surface of the grinding sheet (463) to the distal surface of the grinding sheet (463) as shown in FIG. 8. The grinding sheet (463) with different diversion hole (4632, 4632*a*, 4632*b*) can be arranged according to desired effect. When the mixed fluid passes the grinding sheets (463), the grinding sheets (463) rotate relatively to grind and disperse the mixed fluid to obtain a ground fluid. The ground fluid is released into the inner chamber (4615).

The fastening shaft (464) is T shaped and has a shaft body (4641) and a first cushion (4642). The shaft body (4641) is mounted in the axle holes (4631) of the grinding sheets (463) and has a proximal end and a distal end. The distal end of the shaft body (4641) faces the cover (462). The first cushion (4642) is mounted on the distal end of the shaft body (4641) and has a proximal surface and a distal surface. The proximal surface abuts the grinding sheet (463) that is closest to the cover and allows all grinding sheets (463) to be mounted between the proximal surface of the first cushion (4642) and the annular protrusion (4616).

Figure 9:
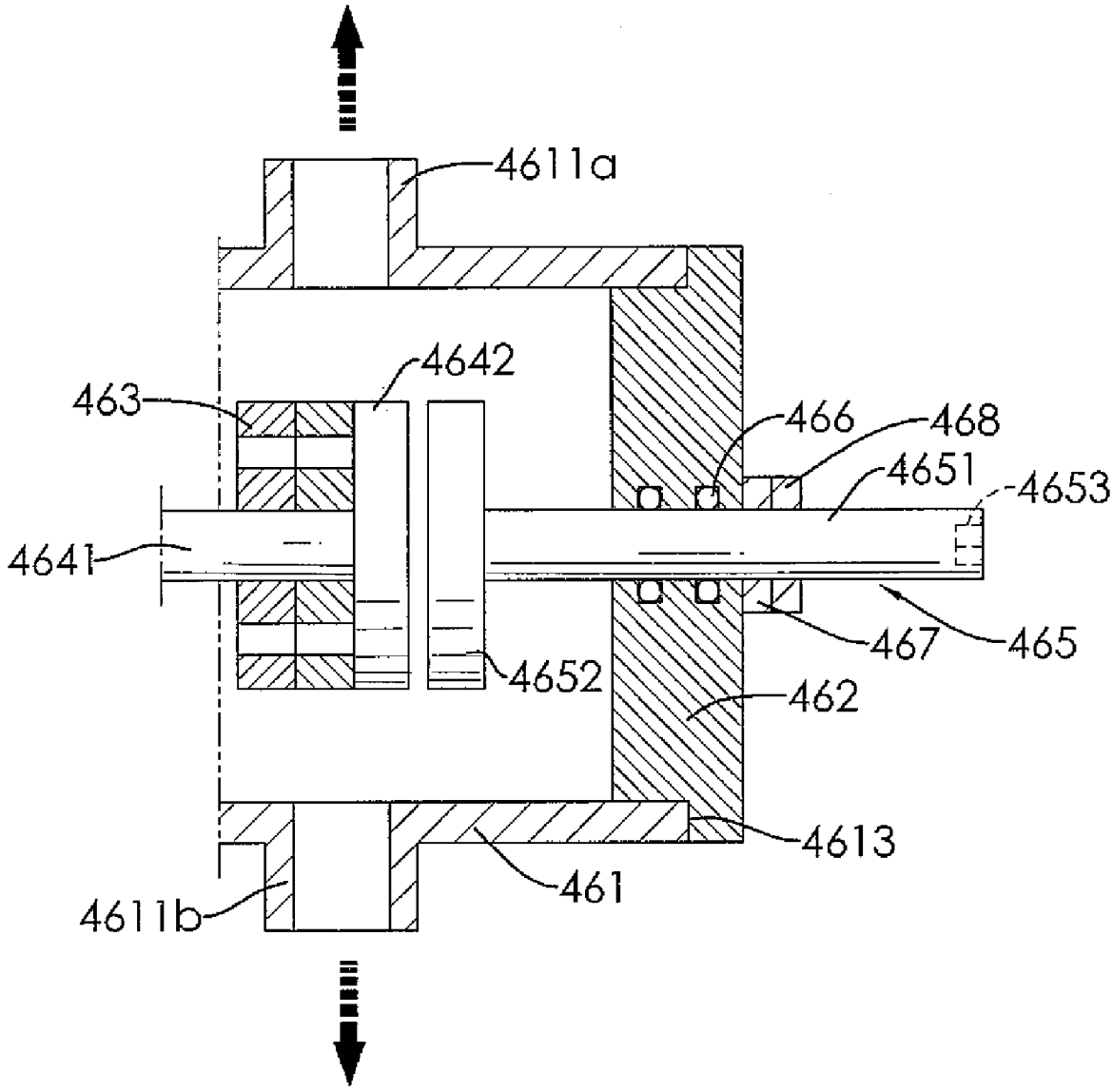
FIG. 9 is a top view in partial section of a distal part of the grinding device in FIG. 4.

With further reference to FIG. 9, the pressure regulating shaft (465) is T shaped and has a shaft body (4651) and a second cushion (4652).

The shaft body (4651) of the pressure regulating shaft (465) may be threaded, protrudes in the central hole (4621) of the cover (462) and has a proximal end, a distal end, at lest one rubber seal ring (466), a positioning nut (467) and a fastening nut (468). The proximal end of the shaft body (4651) faces the first cushion (4642) of the fastening shaft (464) and is mounted in the barrel (461). The distal end of the shaft body (4651) is mounted out of the barrel (461) and has a screw recess (4653). The screw recess (4653) is formed in the distal end of the shaft body (4651) and allows a screwdriver to protrude in the screw recess (4653) and rotate and adjust the pressure regulating shaft (465). The rubber seal ring (466) is mounted in the central hole (4621) of the cover (462) and around the shaft body (4651). The positioning nut (467) is mounted around the shaft body (4651) and out of the barrel (461) and abuts the cover (462) to position the pressure regulating shaft (465). The fastening nut (468) is mounted around the shaft body (4651) and selectively abuts the positioning nut (467). After the positioning nut (467) is adjusted, the fastening nut (468) tightly abuts the positioning nut (467) and the friction between the positioning and fastening nuts (467, 468) prevents the positioning nut (467) from inadvertently moving on the shaft body (4651) to fasten the pressure regulating shaft (465).

The second cushion (4652) is mounted on the proximal end of the shaft body (4651) and has a proximal surface and a distal surface. The proximal surface abuts the distal surface of the second cushion (4642) and applies an applicable pressure to press the grinding sheets (463). The distal surface connects to the proximal end of the shaft body of the pressure regulating shaft (465).

The second grinding device (45) connects to the sidewall of the pressure equalizer (41) opposite to the first grinding device (46), communicates with the inner chamber of the pressure equalizer (41) and has at least one ground fluid outlet (4511) and a backflow pipe (451). The backflow pipe (451) connects to and communicates with the ground fluid outlet (4511) and the raw material feeder (10) to connect the second grinding device (45) with the raw material feeder (10) and the backflow pipe (451) has a solenoid valve (452). The second grinding device (45) has a same structure of the first grinding device (46).

The subsequent treatment plant (50) connects to the first grinding device (46) and has a bottle filling machine (51), a filling pipe (52), a relief tank (53) and a connecting pipe (54). The bottle filling machine (51) is used to bottling the ground fluid. The filling pipe (52) connects to the bottle filling machine (51) to the ground fluid outlet (4611*a*, 4611*b*) of the first grinding device (46) and has a solenoid valve (521). The relief tank (53) has a bottom, an inner chamber and a ground fluid outlet (53). The inner chamber of the relief tank (53) receives the ground fluid. The ground fluid outlet (53) connects to the bottom of the relief tank (53) and communicates with the inner chamber of the relief tank (53). The connecting pipe (54) connects the relief tank (53) to the ground fluid outlet (4611*a*, 4611*b*) of the first grinding device (46) and has a solenoid valve (541).

When the nano grinding and dispersing assembly of the present invention is used, a liquid raw material is conveyed into the inner chamber of the raw material feeder (10) via the feeding pipe (11). The liquid raw material flows in the delivering pipe (12) and is pumped by the pump (13) to flow in the pressurized feeding pipe (42). Then, the liquid raw material flows into the pressure equalizer (41) via the joint (411) and is ground and dispersed by the second grinding device (45). Because the liquid raw material may contain tiny organic matter, the liquid raw material is homogeneous and uniform after passing through the second grinding device (45). After being ground, the liquid raw material flows back to the inner chamber of the raw material feeder (10) via the backflow pipe (451) to circulate the liquid raw material.

After the liquid raw material is homogeneous, liquid, solid or gas applied from the liquid supply unit (20) or the gas supply unit (30) are mixed with the liquid raw material to form a mixed fluid. The mixed fluid flows into the pressure equalizer (41) via the pressurized feeding pipe (42) and the pressurized feeding pipe (42). If the mixed fluid contains surplus gas, the surplus gas can be released from the gas outlet (431) of the gas-liquid separator (43). Then the mixed fluid flows into the first grinding device (46) from the inlet channel (4614). The pressure regulating shaft (465) is adjusted according to the pressure gage (44) to apply an applicable pressure to press the grinding sheets (463). The mixed fluid passes the grinding sheets (463) to drive the grinding sheets (463) to rotate relatively, so the mixed fluid is ground and dispersed to obtain a ground fluid. The ground fluid is released into the inner chamber (4615) of the barrel (461) and then is discharged from the first grinding device (46) through the ground fluid outlet (4611*a*, 4611*b*) and via the filling pipe (52) or the connecting pipe (54) to the bottle filling machine (51) or the relief tank (53).

Raw material in the raw material feeder (10) of the present invention is liquid and the mixed fluid may be gas-liquid system, solid-liquid system or liquid-liquid system.

In the gas-liquid system, gas is supplied from the gas supply unit (30) and includes, but not limited to air, nitrogen, oxygen, ozone, hydrogen, carbon monoxide, carbon dioxide, sulfur dioxide, nitric dioxide or the like. In one aspect, a suitable amount of air and coagulants are mixed into wastewater. After wastewater with air passes through the first grinding device (46) of the pressure equalized assembly (40), the wastewater is full of nano-scaled air bubbles. Impurities such as pollutants, suspended solid or the like in the wastewater are removed by flotation. In other aspect, ozone is mixed in tap-water, nitrogen is mixed in beverages or alcohols for preserving beverages or alcohols, oxygen is mixed in mineral water for increasing oxygen concentration, oxygen or ozone is mixed in water in a bath, sulfur dioxide or ozone is mixed in industrial bleach, oxygen is mixed in fish-raising water or the like.

In the solid-liquid system, solid comprises solid powders that are mixed in liquid and are supplied from the liquid supply unit (20). After solid-liquid mixed fluid passes through the first grinding device (46), the solid powders are ground to nano-scaled powders. After dehydration, dried nano-scaled powders are obtained. In one aspect, the solid includes algae, pollen or the like. Cell walls of algae, pollen or the like are broken and algae, pollen or the like are ground into nano-scaled powders after pass through the first grinding device (46). In another aspect, the solid includes ceramic material, which can be ground into nano-scaled powers. In yet another aspect, the solid includes organic additives in cosmetics. The organic additives are homogenous and fined in cosmetics after passing the pressure equalized assembly (40).

In the liquid-liquid system, two liquids are respectively supplied from the raw material feeder (10) and the liquid supply unit (20). Two liquids can be mixed homogeneously after passing through the first grinding device (46) of the pressure equalized assembly (40). For example, without limitation, a suitable amount of water or organic solvent in mixed with organic oil (miscible water and oil) for being used conveniently, water is mixed with fuel oil for increasing combustion efficiency and lowering air pollution, ethanol is mixed with high-performance fuel, high-performance oil is mixed in low-performance ethanol or the like.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A nano grinding and dispersing assembly comprising:
- a raw material feeder having
  - an inner chamber;
  - a feeding pipe connecting to the raw material feeder and communicating with the inner chamber of the raw material feeder; and
  - a delivering pipe connecting to the raw material feeder and communicating with the inner chamber of the raw material feeder and having a pump;
- a liquid supply unit connecting to the delivering pipe of the raw material feeder;
- a gas supply unit connecting to the delivering pipe of the raw material feeder;
- a pressure equalized assembly having
  - a pressure equalizer;
  - a pressurized feeding pipe connecting and communicating with the pressure equalizer and the delivering pipe;
  - a gas-liquid separator connecting and communicating with the pressure equalizer;
  - a pressure gage connecting to the pressure equalizer; and
  - a first grinding device connecting and communicating with the pressure equalizer and having at least one ground fluid outlet; and
- a subsequent treatment plant connecting to the ground fluid outlet of the first grinding device.

2. The nano grinding and dispersing assembly as claimed in claim 1, wherein the pressure equalized assembly further has a second grinding device connecting to the pressure equalizer and having
- at least one ground fluid outlet; and
- a backflow pipe connecting to and communicating with the ground fluid outlet and the raw material feeder to connect the second grinding device with the raw material feeder.

3. The nano grinding and dispersing assembly as claimed in claim 1, wherein the first grinding device has
- a hollow barrel having
  - an open proximal end connecting to the pressure equalizer;
  - an open distal end having an outlet opening;
  - a sidewall having an inner surface;
  - an inner chamber;

two ground fluid outlets connecting to the sidewall of the barrel and communicating with the inner chamber of the barrel; and an annular protrusion protruding radially inwards from the inner surface of the sidewall and being formed in the inner chamber near the proximal end to form an inlet channel communicating with the pressure equalizer;

a cover being mounted in and sealing the outlet opening of the distal end of the barrel and having a central hole that is defined through the cover and communicates with the inner chamber;

multiple grinding sheets being mounted in the inner chamber and each grinding sheet having a proximal surface;

a distal surface;

an axle hole being defined centrally through the grinding sheet; and multiple diversion holes being formed around the axle hole at intervals;

a fastening shaft being T shaped and having a shaft body being mounted in the axle holes of the grinding sheets and having a proximal end; and a distal end facing the cover; and a first cushion being mounted on the distal end of the shaft body and having a proximal surface abutting the grinding sheet that is closest to the cover and allowing the grinding sheets to be mounted between the proximal surface of the first cushion and the annular protrusion; and a distal surface; and a pressure regulating shaft being T shaped and having a shaft body protruding in the central hole of the cover and having a proximal end facing the first cushion of the fastening shaft and being mounted in the barrel;

a distal end being mounted out of the barrel and having a screw recess that is formed in the distal end of the shaft body;

at lest one rubber seal ring being mounted in the central hole of the cover and around the shaft body;

a positioning nut being mounted around the shaft body and out of the barrel and abutting the cover to position the pressure regulating shaft; and a fastening nut being mounted around the shaft body and being adjacent to the positioning nut to fasten the pressure regulating shaft;

a second cushion being mounted on the proximal end of the shaft body and having a proximal surface abutting the distal surface of the second cushion; and a distal surface connecting to the proximal end of the shaft body of the pressure regulating shaft.

4. The nano grinding and dispersing assembly as claimed in claim 2, wherein the second grinding device has a same structure of the first grinding device and each grinding device has a hollow barrel having an open proximal end connecting to the pressure equalizer;

an open distal end having an outlet opening;

a sidewall having an inner surface;

an inner chamber;

two ground fluid outlets connecting to the sidewall of the barrel and communicating with the inner chamber of the barrel; and an annular protrusion protruding radially inwards from the inner surface of the sidewall and being formed in the inner chamber near the proximal end to form an inlet channel communicating with the pressure equalizer;

a cover being mounted in and sealing the outlet opening of the distal end of the barrel and having a central hole that is defined through the cover and communicates with the inner chamber;

multiple grinding sheets being mounted in the inner chamber and each grinding sheet having a proximal surface;

a distal surface;

an axle hole being defined centrally through the grinding sheet; and multiple diversion holes being formed around the axle hole at intervals;

a fastening shaft being T shaped and having a shaft body being mounted in the axle holes of the grinding sheets and having a proximal end; and a distal end facing the cover; and a first cushion being mounted on the distal end of the shaft body and having a proximal surface abutting the grinding sheet that is closest to the cover and allowing the grinding sheets to be mounted between the proximal surface of the first cushion and the annular protrusion; and a distal surface; and a pressure regulating shaft being T shaped and having a shaft body protruding in the central hole of the cover and having a proximal end facing the first cushion of the fastening shaft and being mounted in the barrel;

a distal end being mounted out of the barrel and having a screw recess that is formed in the distal end of the shaft body;

at lest one rubber seal ring being mounted in the central hole of the cover and around the shaft body;

a positioning nut being mounted around the shaft body and out of the barrel and abutting the cover to position the pressure regulating shaft; and a fastening nut being mounted around the shaft body and being adjacent to the positioning nut to fasten the pressure regulating shaft;

a second cushion being mounted on the proximal end of the shaft body and having a proximal surface abutting the distal surface of the second cushion; and a distal surface connecting to the proximal end of the shaft body of the pressure regulating shaft.

5. The nano grinding and dispersing assembly as claimed in claim 3, wherein each diversion hole has a slanted degree that is between an axis of the diversion hole and horizontal plane and is in a range from 0° to 60°.

6. The nano grinding and dispersing assembly as claimed in claim 4, wherein each diversion hole has a slanted degree that is between an axis of the diversion hole and horizontal plane and is in a range from 0° to 60°.

7. The nano grinding and dispersing assembly as claimed in claim 1, wherein the subsequent treatment plant has a bottle filling machine; and a filling pipe connecting the bottle filling machine to the ground fluid outlet of the first grinding device and having a solenoid valve.

8. The nano grinding and dispersing assembly as claimed in claim 1, wherein the subsequent treatment plant has a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

9. The nano grinding and dispersing assembly as claimed in claim 7, wherein the subsequent treatment plant has
a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

10. The nano grinding and dispersing assembly as claimed in claim 2, wherein the subsequent treatment plant has
a bottle filling machine; and
a filling pipe connecting the bottle filling machine to the ground fluid outlet of the first grinding device and having a solenoid valve.

11. The nano grinding and dispersing assembly as claimed in claim 2, wherein the subsequent treatment plant has
a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

12. The nano grinding and dispersing assembly as claimed in claim 10, wherein the subsequent treatment plant has
a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

13. The nano grinding and dispersing assembly as claimed in claim 4, wherein the subsequent treatment plant has
a bottle filling machine; and
a filling pipe connecting to the bottle filling machine to the ground fluid outlet of the first grinding device and having a solenoid valve.

14. The nano grinding and dispersing assembly as claimed in claim 4, wherein the subsequent treatment plant has
a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

15. The nano grinding and dispersing assembly as claimed in claim 7, wherein the subsequent treatment plant has
a relief tank having
a bottom;
an inner chamber; and
a ground fluid outlet connecting to the bottom of the relief tank and communicating with the inner chamber of the relief tank; and
a connecting pipe connecting the relief tank to the ground fluid outlet of the first grinding device and has a solenoid valve.

16. The nano grinding and dispersing assembly as claimed in claim 2, wherein the liquid supply unit has
a liquid feeding pipe connects the delivering pipe between the raw material feeder and the pump; and
a flow meter is mounted on the liquid feeding pipe.

17. The nano grinding and dispersing assembly as claimed in claim 2, wherein the gas supply unit has
a gas feeding pipe connecting to the delivering pipe between the raw material feeder and the pump; and
a flow meter being mounted on the gas feeding pipe.

18. The nano grinding and dispersing assembly as claimed in claim 16, wherein the gas supply unit has
a gas feeding pipe connecting to the delivering pipe between the raw material feeder and the pump; and
a flow meter being mounted on the gas feeding pipe.

19. The nano grinding and dispersing assembly as claimed in claim 1, wherein
the raw material feeder further has
a top;
a bottom; and
a sidewall;
the feeding pipe connects the sidewall near the top of the raw material feeder and has a valve; and
the delivering pipe connects the bottom of the raw material feeder and has multiple valves that are mounted at interval on the delivering pipe.

20. The nano grinding and dispersing assembly as claimed in claim 2, wherein
the raw material feeder further has
a top;
a bottom; and
a sidewall;
the feeding pipe connects the sidewall near the top of the raw material feeder and has a valve; and
the delivering pipe connects the bottom of the raw material feeder and has multiple valves that are mounted at interval on the delivering pipe.

* * * * *